United States Patent [19]

Saito et al.

[11] 4,369,900

[45] Jan. 25, 1983

[54] MANUAL ACCUMULATOR TYPE ATOMIZER

[75] Inventors: Tadao Saito; Takao Kishi; Yoshiyuki Kakuta, all of Tokyo, Japan

[73] Assignee: Yoshino Kogyosho Co., Ltd., Tokyo, Japan

[21] Appl. No.: 347,499

[22] Filed: Feb. 10, 1982

Related U.S. Application Data

[63] Continuation-in-part of Ser. No. 320,005, Nov. 10, 1981, abandoned, which is a continuation of Ser. No. 146,394, May 5, 1980, abandoned.

[30] Foreign Application Priority Data

May 16, 1979 [JP] Japan ..... 54-66089[U]
Jun. 28, 1979 [JP] Japan ..... 54-88980[U]

[51] Int. Cl.[3] ..... B65D 47/34

[52] U.S. Cl. ..... 222/321; 222/380; 222/382; 222/383

[58] Field of Search ..... 222/321, 382, 383, 384, 222/385, 380, 378, 379, 381; 239/333

[56] References Cited

U.S. PATENT DOCUMENTS

| | | | |
|---|---|---|---|
| 4,017,031 | 4/1977 | Kishi et al. | 222/321 X |
| 4,111,367 | 9/1978 | Hayes | 222/321 X |
| 4,162,746 | 7/1979 | Anderson et al. | 222/321 X |
| 4,179,049 | 12/1979 | Umstead | 222/321 X |

*Primary Examiner*—Allen N. Knowles
*Attorney, Agent, or Firm*—Stevens, Davis, Miller & Mosher

[57] ABSTRACT

An accumulator type, rechargeable atomizing mechanism having a container for liquid to be atomized, an atomizer body, and atomizer head and an engaging member having a large-diameter hollow cylindrical portion. The atomizer head cooperates with skirt-like small and large diameter pistons formed on a piston member. The large-diameter cylindrical portion of the engaging member is held within the peripheral wall of the atomizer head and is formed with a rod portion extending downwardly from the large-diameter cylindrical portion. The atomizer body is formed with a lower, small-diameter cylindrical portion. The large-diameter piston is held by the large-diameter cylindrical portion of the engaging member and the small-diameter piston is held by the small-diameter portion of the atomizer body. A longitudinal recess is formed on an upper, large-diameter cylindrical guide portion of the atomizer body, and a hole is perforated at the junction between the upper and lower cylindrical portions of the atomizer body. A longitudinal slot is formed on the upper portion of a rod-like valve which extends downwardly from the rod portion of the engaging member. When the valve body reaches its lowermost position, this longitudinal slot communicates the interior of an accumulator chamber (formed by the piston member and the engaging member) with a passage which is connected to a suction tube extending from the liquid to be atomized. This operates to release residual pressure from the accumulator chamber into the suction passage and prevents a residual pressure from opacifying liquid in the container.

6 Claims, 5 Drawing Figures

20
21
26c
26b
31b
23
26a
41b
24
30a
26
31a
22
40a
41a
13
25
41c
14
7
32a
11
42a
4
1
2
12
60
3
42b
33a
33
71
5
6
9
10
35
70
50
8

MANUAL ACCUMULATOR TYPE ATOMIZER

CROSS REFERENCE TO RELATED APPLICATIONS

The present application is a continuation-in-part of U.S. Ser. No. 320,005 filed Nov. 10, 1981 which in turn is a continuation of U.S. Ser. No. 146,394 filed May 5, 1980 both of which are now abandoned.

BACKGROUND OF THE INVENTION

1. Field of the Invention

The present invention relates to atomizers, and more particularly, to manually operated, accumulator type atomizers for atomizing liquids such as perfumes, cosmetic preparations or the like.

"Manual accumulator type atomizer" will be used in this application to mean an atomizer which uses a manually operated pumping mechanism. In general, this pumping mechanism evacuates the interior of an accumulator chamber of the mechanism, at which time a suction valve is opened to intake liquid from a container upon which the atomizer is mounted. When the interior of the accumulator is pressurized again by pumping, an exhaust valve is opened to expel liquid from a nozzle outlet. The present invention is an improvement upon devices disclosed in application Ser. No. 134,186, filed on Mar. 26, 1980 (now abandoned), a continuation-in-part of which (Ser. No. 347,498, filed Feb. 10, 1982) is copending with this application.

2. Description of the Prior Art

Atomizers of this type generally open their exhaust valves only when the interior of the accumulator chamber becomes greater than a predetermined pressure. The exhaust valve automatically closes when the pressure decreases below that predetermined pressure. This provides a disadvantage in that increased pressure (although lower than the predetermined pressure) is retained in the accumulator chamber. Thus the accumulator chamber becomes insufficiently evacuated during the return stroke. It had been proposed to eliminate this disadvantage by providing a hole in the upper surface of a cylinder which forms the accumulator chamber and to form an exhaust passage for the residual pressure which communicates between this hole and the inner surface of the accumulator chamber to allow release of the pressure when the atomizer head would reach its lower most position. However, liquid was exhausted as well as air when the residual pressure was released, causing the liquid to flow down the inner wall of the container which held the liquid. This was detrimental to the appearance of the container. Moreover, bubbles would be mixed with the liquid, which could opacify the liquid and give an appearance of impurities in the liquid.

SUMMARY OF THE INVENTION

It is an object of the present invention to provide a manual, accumulator type atomizer which overcomes disadvantages described above.

It is a further object of this invention to provide an atomizer which does not exhaust liquid along with residual pressure.

It is a still further object of this invention to provide an atomizer which prevents opacification of liquid held in a container.

It is a still further object of this invention to provide an atomizer of simple and economical construction.

The above objects and others will become more apparent and understandable by the following description and appended claims when read in conjunction with the accompanying drawings.

DETAILED DESCRIPTION OF THE INVENTION

Figure 1:
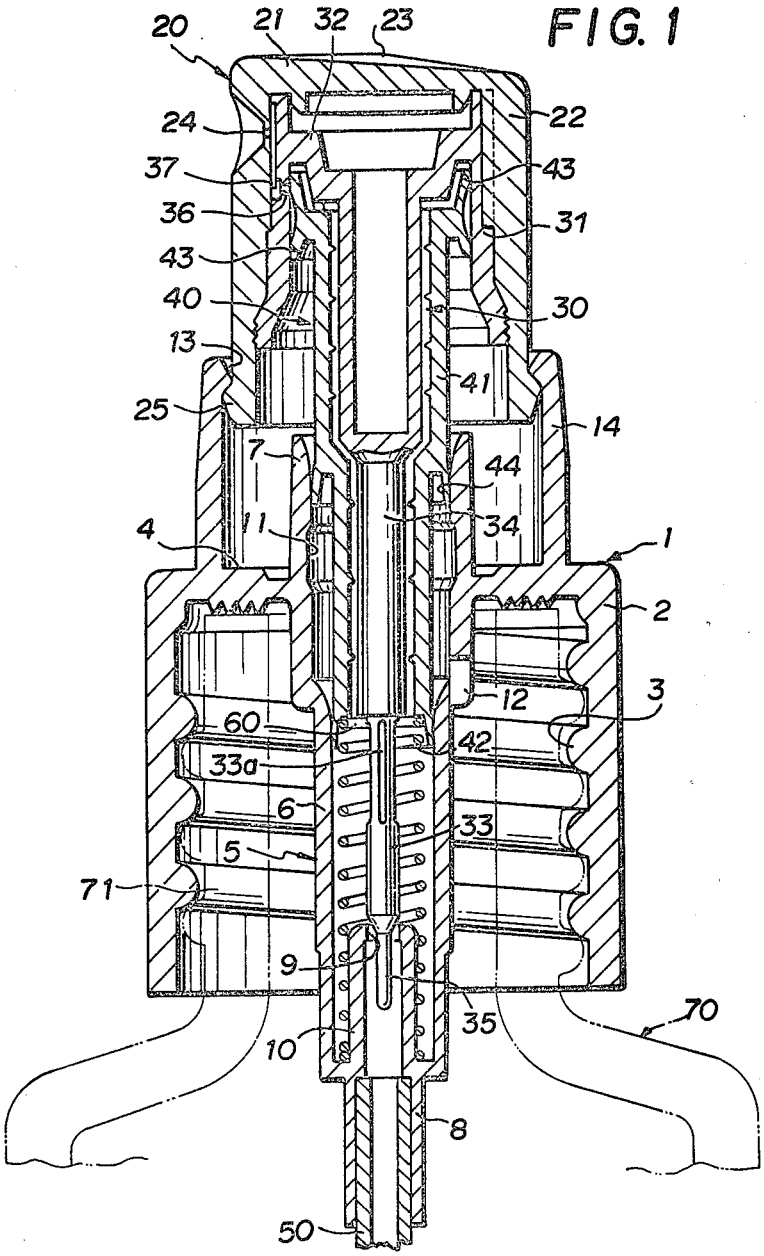
FIG. 1 is a longitudinal sectional elevation of the upper portion of an accumulator type atomizer according to the present invention.

Referring to the drawings, an atomizer according to the present invention is basically made of six essential members; an atomizer body 1, an atomizer head 20, an engaging member 30, a piston member 40, a suction tube 50 and a spring 60. The atomizer body 1 is provided with a peripheral wall 2 which engages a neck portion of a container. As is well known, this peripheral wall may be provided with internal threads 3. A flange-like upper wall 4 extends radially inwardly from the peripheral wall 2. A main cylindrical portion 5 is integrally formed from the upper wall 4. This main cylindrical portion 5 has a lower, small-diameter cylindrical portion 6 formed at its lower portion, an upper, large-diameter cylindrical guide portion 7 formed at its upper portion and a suction tube-engaging hollow cylindrical portion 8 extending downwardly from the lower end of lower portion 6. The guide portion 7 extends both above and below the upper wall 4. A suction valve hole 9 is provided at the inside bottom of the lower cylindrical portion 6. As can be seen in the drawings, it is preferred that this valve hole 9 be provided at the upper end of a hollow cylindrical valve portion 10 which extends upwardly from the lower most end of the cylindrical portion 6. An annular recess 11 is formed in the cylindrical guide portion 7, and a hole 12 is provided at the junction between the lower cylindrical portion 6 and the cylindrical guide portion 7.

The atomizer body is also provided with an engaging tubular portion 14 for cooperation with the atomizer head 20. A peripheral wall 22 extends downwardly from the top of the atomizer head 21. A recess 23 is formed on the top of the atomizer head to facilitate operation with a finger. A nozzle outlet 24 is provided at the upper side face of the atomizer head. The atomizer head is movable with respect to the atomizer body, and is held in place in the atomizer body by means of the cooperation of land 13 of the atomizer body with land 25 of the atomizer head. This prevents accidental removal of the head from the body.

An engaging member 30 is provided with a large-diameter hollow cylindrical portion 31, which is held within the atomizer head 20. A rod portion 34 extends downwardly from connecting portion 32 of the engaging member. A rod-like valve body 33 extends downwardly from the rod portion 34. This valve body 33 is engageable with the suction valve hole 9 for watertightly sealing the valve hole 9. Thus, valve body 33 and valve hole 9 form a suction valve. It is preferred that a guide extension 35 be provided at the end of valve body 33.

A nozzle opening 36 is provided in the large-diameter cylindrical portion 31. This nozzle opening 36 is normally closed by a large-diameter piston 43, as will be described in greater detail, and communicates with nozzle outlet 24 by means of exhaust passage 37. This passage 37 may be constructed so as to spin liquid which passes therethrough.

A piston member 40 is provided with a tubular portion 41 which is slidably engaged on the rod portion 34. The piston member is formed with a skirt-like, small-diameter piston 42 at its lower end and a skirt-like, large-diameter piston 43 at its upper end. Piston 42 is surrounded by the lower, small-diameter cylindrical portion 6 of the atomizer body and piston 43 is surrounded by the upper, large-diameter cylindrical portion 31 of the engaging member. In the embodiment of FIG. 1, an intermediate piston 44 is provided between the large and small diameter pistons. The piston 44 is surrounded by the guide portion 7. A gap is formed between the inner surface of the tubular portion 41 and the outer surface of the rod portion 34 to allow communication between the small-diameter cylindrical portion 6 and the large-diameter cylindrical portion 31.

A tube-engaging cylindrical portion 8 may be provided to extend downwardly from the lower extremity of the atomizer body. Suction tube 50 is held by this engaging portion 8. Of course, it is preferred that the tube 50 have a length so as to reach the bottom of the container.

A coil spring 60 is provided between the main cylindrical portion 5 of the atomizer body 1 and the piston number 40 to urge piston number 40, engaging member 30 and atomizer head 20 upwardly. In the embodiment of FIG. 1, the coil spring 60 is interposed between the inner bottom surface of the cylindrical portion 6 and the lower end of tubular portion 41. However, this particular arrangement is not necessary and other dispositions of the spring may be used depending upon the specific application.

This spring 60 urges the small-diameter piston 42 towards the upper most portion of the small-diameter cylindrical portion 6. The large-diameter piston 43 is urged towards the upper most end of the large-diameter cylindrical portion 31 and the intermediate-diameter piston 44 is urged towards the upper most end of the cylindrical guide portion 7. Also, land 25 of the atomizer head wall 22 is urged into contact with land 13 formed on the tubular portion 14. Valve body 9 is thus urged out of valve hole 9 so that the suction valve is opened. The nozzle opening 36 is closed by large-diameter piston 43 in the upper most position.

Figure 4:
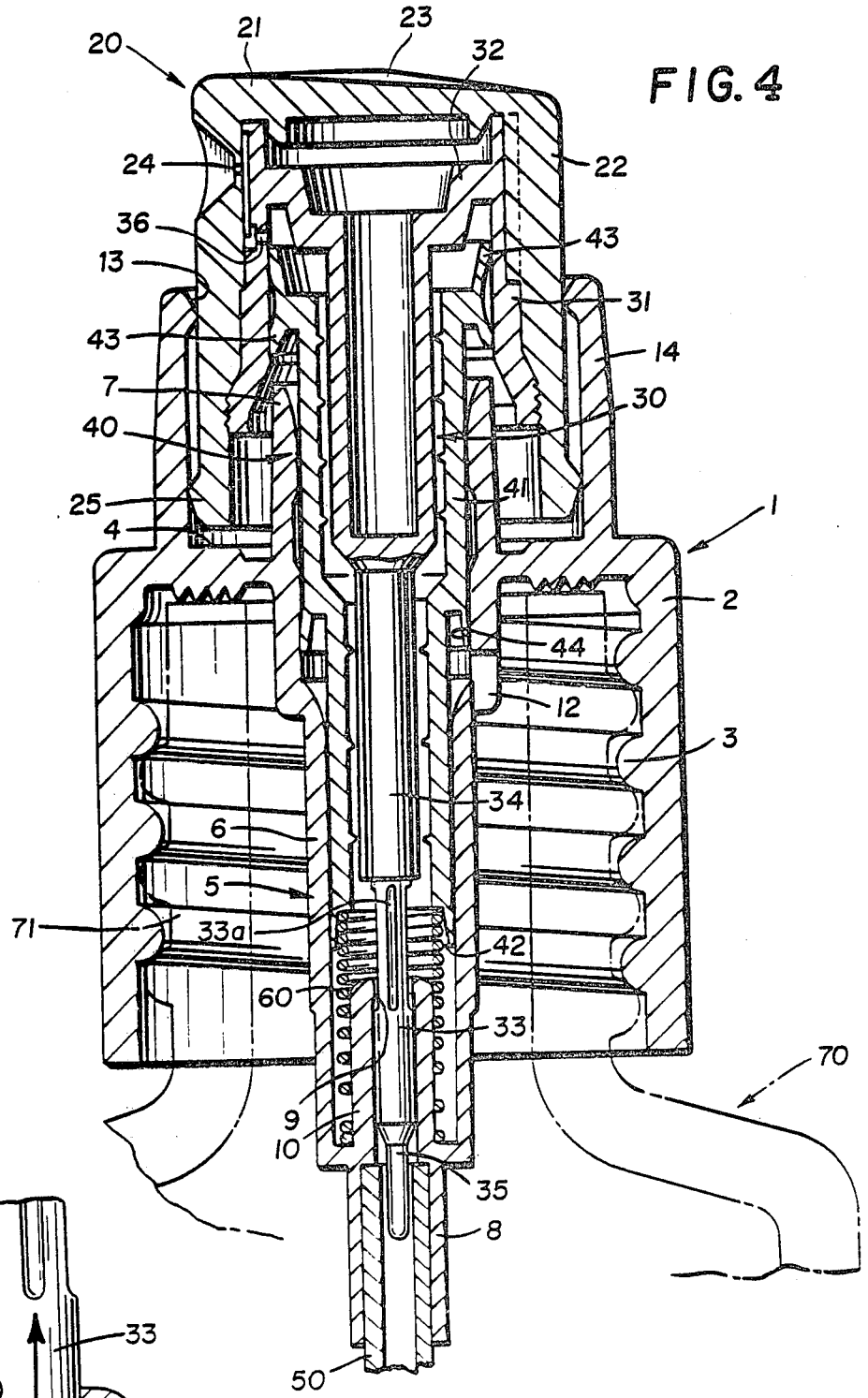
FIG. 4 shows the atomizer of FIG. 1 after the atomizer head has been depressed.
Figure 5:
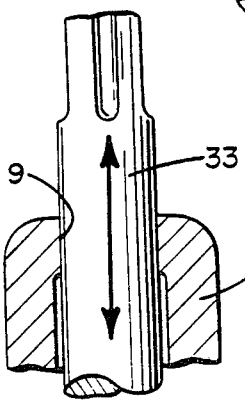
FIG. 5 shows an enlarged view of part of the atomizer during operation.

The atomizer of the present invention further includes a longitudinal slot **33*a* formed in the upper portion of the valve body 33. It is preferred that a plurality of such slots be provided. This slot 33*a* operates to communicate the interior of the accumulator chamber (formed by the lower portion 6, and the space between the piston and engaging members) with the suction tube 50 when the valve body is in its lower most position. This is shown in FIGS. 4 and 5. The length of the slots 33*a*** may be varied, depending upon the dimensions of the particular atomizer.

The atomizer of the present invention is screwed onto the neck portion 71 of a container body 70 which is filled with liquid. Before the atomizer head is manually depressed for the first time against the tension of the spring 60, the accumulator chamber (formed by cylindrical portion 31, cylindrical portion 6 and piston member 40) is filled with air. As the head is depressed, valve body 33 slides into suction valve hole 9 to close the suction valve. The valve body has substantially the same diameter as the valve hole 9. As the head is continually depressed, the pressure within the accumulator chamber increases. This increase in pressure causes piston number 40 to slide downwards with respect to engaging member 30, due to the difference in diameters between the large-diameter and small-diameter portions 31 and 6. Thus, large-diameter piston 43 moves downwardly with respect to large-diameter cylinder 31.

As the piston 43 moves downwardly with respect to engaging member 30, exhaust valve 36 becomes open so that compressed air is exhausted through the nozzle outlet 24. This is shown in FIG. 4. As is also shown in FIG. 4, when the valve body 33 reaches its lowermost limit, the longitudinal slot **33*a* allows communication of the interior of the accumulator chamber with the suction tube 50, exhausting any residual pressure held within the accumulator chamber. As the pressure within the accumulator chamber decreases, piston 43 is again urged upwardly by the tension of spring 60. When manual pressure on the atomizer head 20 is released, piston member 40, engaging member 30 and atomizer head 20 are urged upwardly, basically as a single unit. This causes evacuation of the accumulator chamber. Thus, as valve hole 9 is opened when the valve body 33 moves clear of the valve hole, liquid may be brought in to the accumulator chamber from the container body through suction tube 50**.

Thus when atomizer head 20 is again depressed, compressed liquid is atomized through nozzle outlet 24 in the same manner that compressed air was expelled upon the first depression. Evacuation of the liquid container is avoided by the provision of piston 44 and anular recess 11. When the piston 44 reaches recess 11 during the downward movement, a passage formed between the outer surface of the tubular portion 41 and the inner surface of cylindrical guide portion 7. This allows atmospheric air to enter the container through hole 12 and prevent negative pressure within the container.

From the above description, it is clear that the atomizer of this invention is constructed to exhaust residual pressure from the accumulator chamber into the liquid suction tube 50 by means of slots **33*a* when the valve body 33** reaches its lower most position. Thus, it prevents liquid from the container being exhausted with residual pressure onto the inner wall surface of the container. It also prevents liquid contained in the container from being opacified due to air contained within liquid exhausted along with residual pressure.

Figure 2:
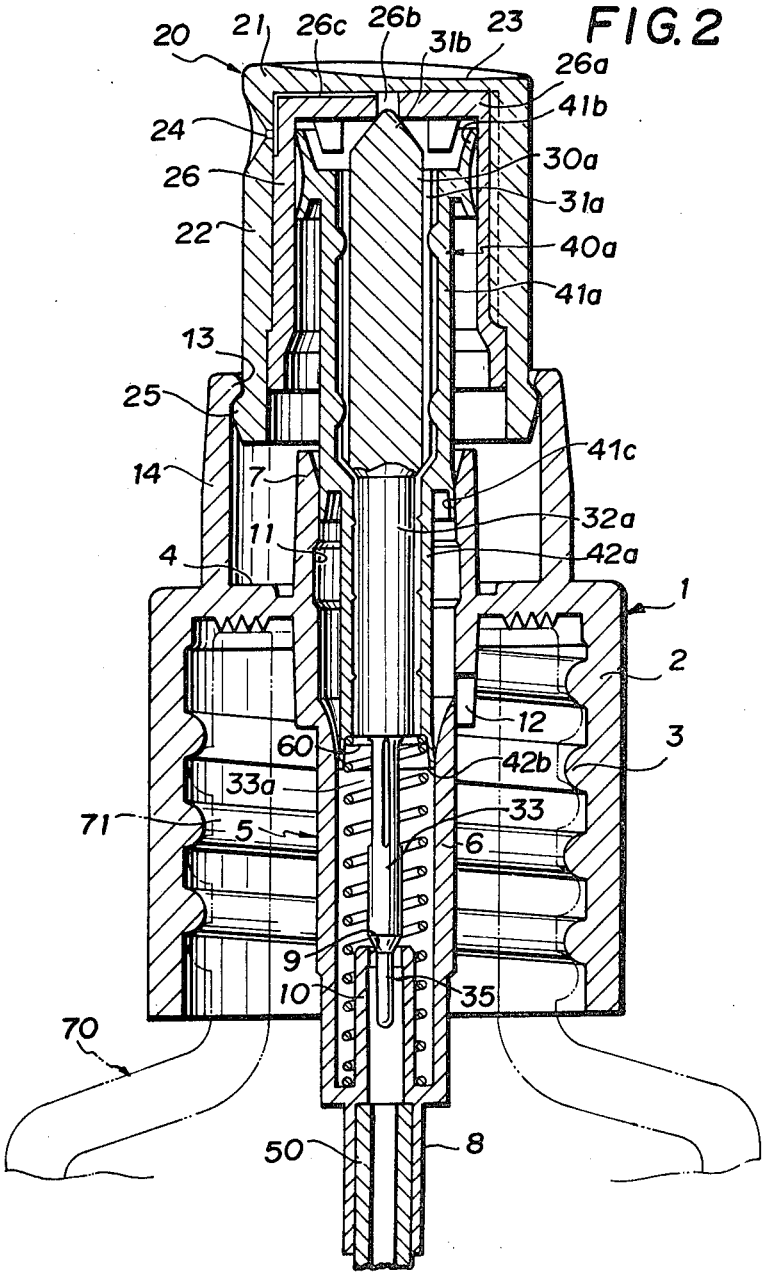
FIG. 2 shows a view similar to that of FIG. 1, showing a second embodiment of the present invention.

FIG. 2 shows a second embodiment of an atomizer according to this invention. A large-diameter cylinder in this embodiment is carried by the peripheral wall 22 of the atomizer head 20. An exhaust valve hole **26*b* is provided at the center of the top wall 26*a* of cylinder 26. Exhaust passage 26*c* is formed to communicate with nozzle outlet 24 so that liquid may pass through valve hole 26*b* to outlet 24. Passage 26*c*** may be constructed so as to spin liquid which passes therethrough.

Engaging member **30*a* extends from the large-diameter cylinder 26 to the small-diameter hollow cylindrical portion 6, and is provided with a large-diameter rod portion 31 having a conical valve body 31*b* at its top. This valve body 31*b* cooperates with valve hole 26*b* to form an exhaust valve. The engaging member 30***a* is movable relative to large-diameter cylinder 26. The engaging member 30*a* is provided with an intermediate-diameter rod portion 32*a* and with a small-diameter valve body 33. This valve body 33 cooperates with valve hole 9 as explained in connection with in FIG. 1. The valve body 33 may also be provided with a guide member 35, as before.

Piston member 40*a* has an upper, tubular portion 41*a* secured to the outer periphery of the large-diameter portion 31*a*, and is formed with an upper, skirt-like, large-diameter piston 41*b* which is slidably inserted into the large-diameter cylinder 26. A lower, tubular portion 42*a* is slidably engaged on the outside of the intermediate-diameter rod portion 32*a*, and is formed with an intermediate, skirt-like piston 41*c*, which is slidably inserted in cylindrical guide portion 7. The piston member 40*a* also carries a lower, skirt-like, small-diameter piston 42, which is surrounded by the small-diameter cylindrical portion 6. This piston 42 is preferably carried at the end of the piston member 40*a*.

A gap is formed between the inner surface of tubular portions 41*a* and 42*a* and the outer peripheries of large-diameter and intermediate-diameter rod portions 31 and 32*a*, so that small-diameter cylindrical portion 6 and large-diameter cylinder 26 are in fluid communication with each other. Thus, a liquid passage is formed between the outer surface of the engaging member 30 and the inner surface of the piston member 40. Thus liquid may pass from the suction tube 50 through this liquid passage and then through passage 26*c* and nozzle outlet 24 when valve hole 26*b* is opened.

The spring 60 urges the small-diameter piston 42*b* towards the upper end of the small-cylindrical portion 6. The large-diameter piston 41*b* is urged towards the upper most portion of large-diameter cylinder 26. Piston 41*c* is urged towards the upper most portion of cylindrical guide portion 7. Land 25 of the peripheral wall 22 of the atomizer head 20 is engaged with land 13 of the tubular guide portion 14 of the atomizer body. Valve hole 9 is opened, since valve body 33 is urged upwardly and clear of the valve hole 9. Valve hole 26*b* is closed by conical valve body 31*b*.

The atomizer of this embodiment operates in much the same manner as that of the embodiment of FIGS. 1 and 4. When the atomizer head is suppressed, the pressure within the accumulator chamber increases, causing the piston member 40 to move downwardly with respect to large-diameter cylinder 26. This carries the member 31*a* downwardly, and causes valve hole 26*b* to be opened so that fluid may pass through passage 26*c* and outlet nozzle 24. This embodiment provides simpler manufacture of the atomizer, since the large-diameter cylinder 26 is formed separately from engaging member 31. This allows for easier molding steps.

Figure 3:
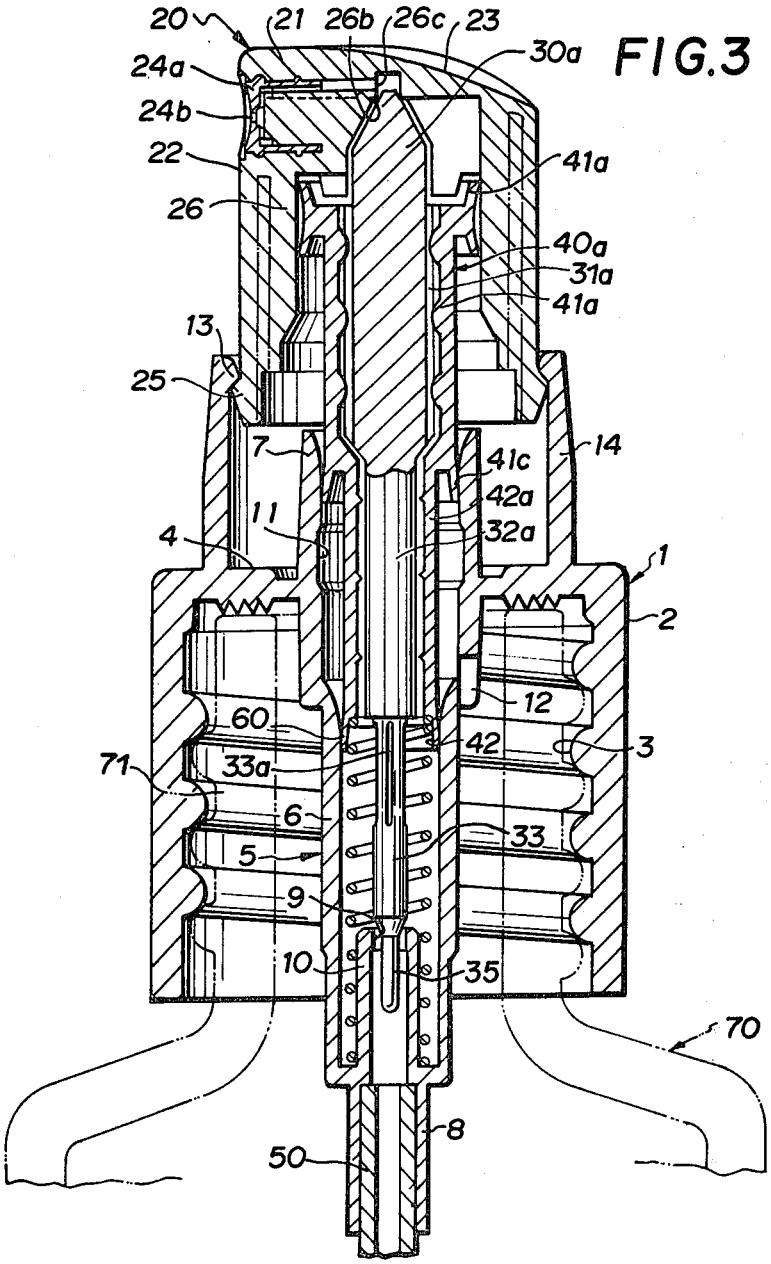
FIG. 3 shows a view similar to that of FIG. 1 but showing still another embodiment of the present invention.

FIG. 3 shows another embodiment of the present invention. In this case, the large-diameter cylinder 26 is formed integrally with atomizer head 20. Exhaust hole 26*b* is provided at the top center of the atomizer head, and is in fluid communication with exhaust passage 26*c*. Engaging member 30*a* closes exhaust valve hole 26*b* in the same manner as in FIG. 2. A nozzle body 24*a*, having nozzle outlet 24*b* is carried in an upper side of the peripheral wall 22 of the atomizer head. A spin-imparting portion may be provided on the inner surface of the nozzle body 24*a*. The embodiment of FIG. 3 functions in the same manner as that of FIG. 2. The embodiments of FIG. 2 and FIG. 3 allow simplified construction of the atomizer head and large-diameter cylinder.

What is claimed is:

1. A liquid spraying device, comprising:

a container for holding liquids, having a neck portion;

an atomizer body having a peripheral portion for engaging the neck portion of said container, having a radially inwardly extending flange-like upper wall connected to said peripheral portion and a main cylindrical portion extending vertically from said upper wall, said main cylindrical portion having a lower, small-diameter hollow cylindrical portion and an upper, large-diameter cylindrical guide portion, said guide portion having an annular recess on its inner surface, a hole being perforated at the junction between said small-diameter lower cylindrical portion and said guide portion;

an atomizer head slidably held by said atomizer body, having an upper wall and a peripheral wall;

a large-diameter hollow cylindrical member, having an upper portion and a sidewall with an exhaust hole in the sidewall, held within the peripheral wall of said atomizer head;

an engaging member integral with the upper portion of said large-diameter cylindrical member having a downwardly extending rod portion and rod-like valve body which is slidably located in the small-diameter cylindrical portion of said atomizer body;

a piston member having a tubular portion which is slidably engaged on the rod portion of said engaging member having a skirt-like small-diameter piston at the lower end of said piston member surrounded by the small-diameter cylindrical portion of said atomizer body and a skirt-like large-diameter upper piston surrounded by said large-diameter cylindrical member, said exhaust hole being openable upon relative movement between said piston member and said large-diameter cylindrical member;

a suction tube engaged with the lowermost portion of said small-diameter cylindrical portion of said atomizer body for intake of liquid from said container;

spring means for upwardly urging said atomizer head, said piston member and said engaging member;

said atomizer body having a suction valve hole at the inside bottom of said small-diameter cylindrical portion of said atomizer body, said exhaust hole being in communication with a nozzle outlet formed in said atomizer head, a liquid passage being defined between the outer surface of said engaging member and the inner surface of said piston member, said valve body having a longitudinal slot formed at its upper portion for allowing communication between the small-diameter lower portion of said atomizer body and said suction tube when said valve body reaches a lowermost position.

2. A liquid spraying device, comprising:

a container for holding liquids, having a neck portion;

an atomizer body having a peripheral portion for engaging the neck portion of said container, having a radially inwardly extending flange-like upper wall connected to said peripheral portion and a main cylindrical portion extending vertically from said upper wall, said main cylindrical portion having a lower, small-diameter hollow cylindrical portion and an upper, large-diameter cylindrical guide portion, said guide portion having an annular recess on its inner surface, a hole being perforated at the junction between said small-diameter lower cylindrical portion and said guide portion;

an atomizer head slidably held by said atomizer body, having an upper wall and a peripheral wall;

a large-diameter hollow cylindrical member, having an upper portion with an exhaust hole in the upper portion, held within the peripheral wall of said atomizer head;

an engaging member contactable with the upper portion of said large-diameter cylindrical member for closing said exhaust hole, having a downwardly extending rod portion and rod-like valve body which is slidably located in the small-diameter cylindrical portion of said atomizer body;

a piston member having a tubular portion, for carrying said engaging member, having a skirt-like small-diameter piston at the lower end of said piston member surrounded by the small-diameter cylindrical portion of said atomizer body and a skirt-like large-diameter upper piston surrounded by said large-diameter cylindrical member, said piston member being slidable relative to said large-diameter cylindrical member, said exhaust hole being openable upon relative movement between said piston member and said large-diameter cylindrical member;

a suction tube engaged with the lowermost portion of said small-diameter cylindrical portion of said atomizer body for intake of liquid from said container;

spring means for upwardly urging said atomizer head, said piston member and said engaging member;

said atomizer body having a suction valve hole at the inside bottom of said small-diameter cylindrical portion of said atomizer body, said exhaust hole being in communication with a nozzle outlet formed in said atomizer head, a liquid passage being defined between the outer surface of said engaging member and the inner surface of said piston member, said valve body having a longitudinal slot formed at its upper portion for allowing communication between the small-diameter lower portion of said atomizer body and said suction tube when said valve body reaches a lowermost position.

3. A liquid spraying device, comprising:

a container for holding liquids, having a neck portion;

an atomizer body having a peripheral portion for engaging the neck portion of said container, having a radially inwardly extending flange-like upper wall connected to said peripheral portion and a main cylindrical portion extending vertically from said upper wall, said main cylindrical portion having a lower, small-diameter hollow cylindrical portion and an upper, large-diameter cylindrical guide portion, said guide portion having an annular recess on its inner surface, a hole being perforated at the junction between said small-diameter lower cylindrical portion and said guide portion;

an atomizer head slidably held by said atomizer body, having an upper wall and a peripheral wall and being formed with an interior large-diameter hollow cylindrical portion, having an upper portion with an exhaust valve in the upper portion;

an engaging member contactable with the upper portion of said large-diameter cylindrical portion, for closing said exhaust hole, having a downwardly extending rod portion and rod-like valve body which is slidably located in the small-diameter cylindrical portion of said atomizer body;

a piston member having a tubular portion, for carrying said engaging member, having a skirt-like small-diameter piston at the lower end of said piston member surrounded by the small-diameter cylindrical portion of said atomizer body and a skirt-like large-diameter upper piston surrounded by said large-diameter cylindrical portion, said piston member being slidable relative to said large-diameter cylindrical portion, said exhaust hole being openable upon relative movement between said piston member and said large-diameter cylindrical portion;

a suction tube engaged with the lowermost portion of said small-diameter cylindrical portion of said atomizer body for intake of liquid from said container;

spring means for upwardly urging said atomizer head, said piston member and said engaging member;

said atomizer body having a suction valve hole at the inside bottom of said small-diameter cylindrical portion of said atomizer body, said exhaust hole being in communication with a nozzle outlet formed in said atomizer head, a liquid passage being defined between the outer surface of said engaging member and the inner surface of said piston member, said valve body having a longitudinal slot formed at its upper portion for allowing communication between the small-diameter lower portion said atomizer body and said suction tube when said valve body reaches a lowermost position.

4. A liquid spraying device as claimed in claim 2 or 3, wherein said engaging member comprises an upper, large-diameter rod portion having a conical valve body at the top of said large-diameter rod portion for forming an exhaust valve with said exhaust hole of the large-diameter cylinder, an intermediate-diameter rod portion extending downwardly from said large-diameter rod portion and a small-diameter rod-like body extending downwardly from said intermediate-diameter rod portion.

5. A liquid spraying device as claimed in claim 1, 2 or 3 further comprising a reduced-diameter guide portion extending downwardly from said rod-like body.

6. A liquid spraying device as claimed in any one of claims 1 through 3, wherein said piston member further comprises an intermediate-diameter piston disposed between said large-diameter piston and said small-diameter piston, said intermediate-diameter piston being surrounded by said guide portion of said atomizer body.

* * * * *